US007878137B2

(12) United States Patent
De Medeiros Júnior et al.

(10) Patent No.: US 7,878,137 B2
(45) Date of Patent: Feb. 1, 2011

(54) TORPEDO PILE WITH ENHANCED CLAMPING STRENGTH FOR ANCHORING FLOATING STRUCTURES AND METHOD OF INSTALLATION

(75) Inventors: Cipriano José De Medeiros Júnior, Rio de Janeiro (BR); Luiz Fernando Gomes De Carvalho, Rio das Ostras (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 473 days.

(21) Appl. No.: 11/718,703

(22) PCT Filed: Dec. 20, 2005

(86) PCT No.: PCT/GB2005/004931

§ 371 (c)(1),
(2), (4) Date: Mar. 31, 2008

(87) PCT Pub. No.: WO2006/067410

PCT Pub. Date: Jun. 29, 2006

(65) Prior Publication Data

US 2009/0038525 A1 Feb. 12, 2009

(30) Foreign Application Priority Data

Dec. 21, 2004 (BR) ..... 0405799

(51) Int. Cl.
*B63B 21/26* (2006.01)

(52) U.S. Cl. ..... 114/295

(58) Field of Classification Search ..... 114/295, 114/297–299
See application file for complete search history.

(56) References Cited

U.S. PATENT DOCUMENTS

| | | | | |
|---|---|---|---|---|
| 3,187,705 | A | 6/1965 | Costello et al. | |
| 3,291,092 | A | 12/1966 | Halberg et al. | |
| 4,576,521 | A | 3/1986 | Conrad et al. | |
| 4,682,559 | A | 7/1987 | Schnitzer et al. | |
| 5,215,030 | A * | 6/1993 | Conti | 114/298 |

FOREIGN PATENT DOCUMENTS

| | | |
|---|---|---|
| WO | WO 98/08733 A | 3/1998 |

* cited by examiner

*Primary Examiner*—Stephen Avila
(74) *Attorney, Agent, or Firm*—Sughrue Mion, PLLC

(57) ABSTRACT

A Torpedo Pile (100) is described for the anchoring of floating structures used for drilling and production wells for oil and gas, the pile (100) comprising a tapering body (1) provided with fins (20) and a point (30) for embedding in the seabed, its upper end being provided with at least two plates (2) provided with flaps (3), said flaps being capable of inducing a rotation of the articulation elements (4) when a dragging force is exerted on the system. With the continuation of the dragging force, the plates (2) continue to rotate as far as a final configuration, when the points of contact (6) of stops (5) are reached. The pile (100) comprises one embodiment for permanent anchorage and another for temporary anchorage. The method of installation/withdrawal of the two embodiments is also described.

10 Claims, 3 Drawing Sheets

TORPEDO PILE WITH ENHANCED CLAMPING STRENGTH FOR ANCHORING FLOATING STRUCTURES AND METHOD OF INSTALLATION

FIELD OF THE INVENTION

The present invention relates to the field of equipment for anchoring of floating structures used for drilling and supporting production wells for oil and/or gas, and more specifically to the field of equipment for anchoring these structures using the concept of piles free-falling to become embedded in the sea-bed.

PRINCIPLES OF THE INVENTION

The anchoring of floating structures by the application of vertical load for the drilling and production of oil/gas is effected by means of anchors of the VLA (Vertical Load Anchor) type, gravity structures, plates, embedded piles, or drilled or cemented piles.

Embedded piles are installed by pile drivers, by propulsion, or by a system of suction applicable to short piles of large cross-section. These anchoring systems generally require specialised equipment for carrying out piling installation operations, or, in the case of VLA type anchors, a large free area at the base is necessary for embedding by dragging.

A system for low-cost securing of piling currently available is the free-fall system disclosed in WO 98/08733, incorporated herein by reference, designated the Torpedo Pile. This document refers to a pile for anchoring floating structures in deep and extremely deep water, comprising basically an elongated body, the lower end of which is provided with a tapered point, while the upper end is provided with a closing disk. The body of the pile has vertical fins close to the head. The inside of the body of the pile is filled with material of high specific weight, distributed in such a way that the centre of gravity of the pile is situated well below its centre of buoyancy. The pile is installed by using the potential energy it has at the surface of the sea by releasing it from a ship such that it free-falls and penetrates into the seabed.

The proposed developments notwithstanding, the present technique involves a pile for anchoring floating structures used in the exploitation of oil and/or gas wells which has enhanced clamping power, the pile being installed in the seabed by free-falling. The enhanced clamping strength preferably derives from articulated plates shaped to the upper part of the body, such a pile being described and claimed in the present Application.

SUMMARY OF THE INVENTION

The invention provides a torpedo pile with enhanced clamping strength for vertical load anchoring, comprising a body (1) having provided at one end a pointed tip (30) for embedding in the seabed, said pile being characterised by at least two articulated movable plates (2) provided with flaps (3), said flaps (3) being capable of inducing a rotation of the plates (2) when a dragging force is exerted on the pile, until, the plates (2) reach points of contact (6) of stops (5).

In one embodiment, the invention provides a Torpedo Pile with enhanced clamping strength for anchoring with vertical loads, to be used for oil and gas drilling and production wells, consisting of a body ending in a point for embedding into the seabed, comprising, in the manner of a pile intended for permanent anchoring, vertical fins along said body, and with which:

the upper end of said body is provided on the outside with at least two movable articulated plates provided with flaps, these flaps being capable of inducing a rotation of the articulated elements when a dragging force is exerted on the pile, up to the point at which, at the end of the dragging force, the plates reach points of contact of stops, such that said pile is embedded in the seabed with enhanced clamping strength.

In the embodiment of the Torpedo Pile with enhanced clamping strength for temporary anchoring with vertical loads, this additionally comprises:

internally, a movable cylinder, said cylinder having stops by means of apertures in the wall of the body, in such a way that, during the withdrawal operation of the pile, said movable cylinder is moved by a cable connected to its top, and the stops are moved into the interior of the body through openings until the plates are parallel to the body of the pile.

Accordingly, the invention provides a Torpedo Pile for anchoring with vertical loads, in which flaps in the form of plates induce rotation of the articulated elements when a dragging force is exerted on the pile, up to the point at which the plates reach points of contact of stops, resulting in enhanced clamping strength.

The invention provides a Torpedo Pile with enhanced clamping strength for permanent anchors with vertical loads.

The invention also provides for a Torpedo Pile with enhanced clamping strength for temporary anchoring with vertical loads, the use of which involves the embedding of said pile into seabed and its removal.

BRIEF DESCRIPTION OF THE DRAWINGS

The invention will be further described by way of example only, with reference to the accompanying drawings, in which:—

FIG. 1 appended shows an embodiment of the invention used for permanent anchoring.

FIG. 2 appended shows an embodiment of the invention used for temporary anchoring. FIG. 2A shows the pile with the flaps closed, while

FIG. 3 appended shows the process of withdrawing the pile from seabed, applicable to the temporary anchoring situation.

DETAILED DESCRIPTION OF PREFERRED EMBODIMENTS

The invention makes use of the concept of the free-fall for embedding the Torpedo Pile, provided with a system of articulated plates, with the intention of increasing the clamping strength of the Torpedo Pile for anchoring installations with vertical loads.

The Torpedo Pile, designated overall by the reference number 100, is provided with fins 20 along its length, generally four in number, diametrically opposed, intended to increase the clamping strength of the pile.

Figure 1A:
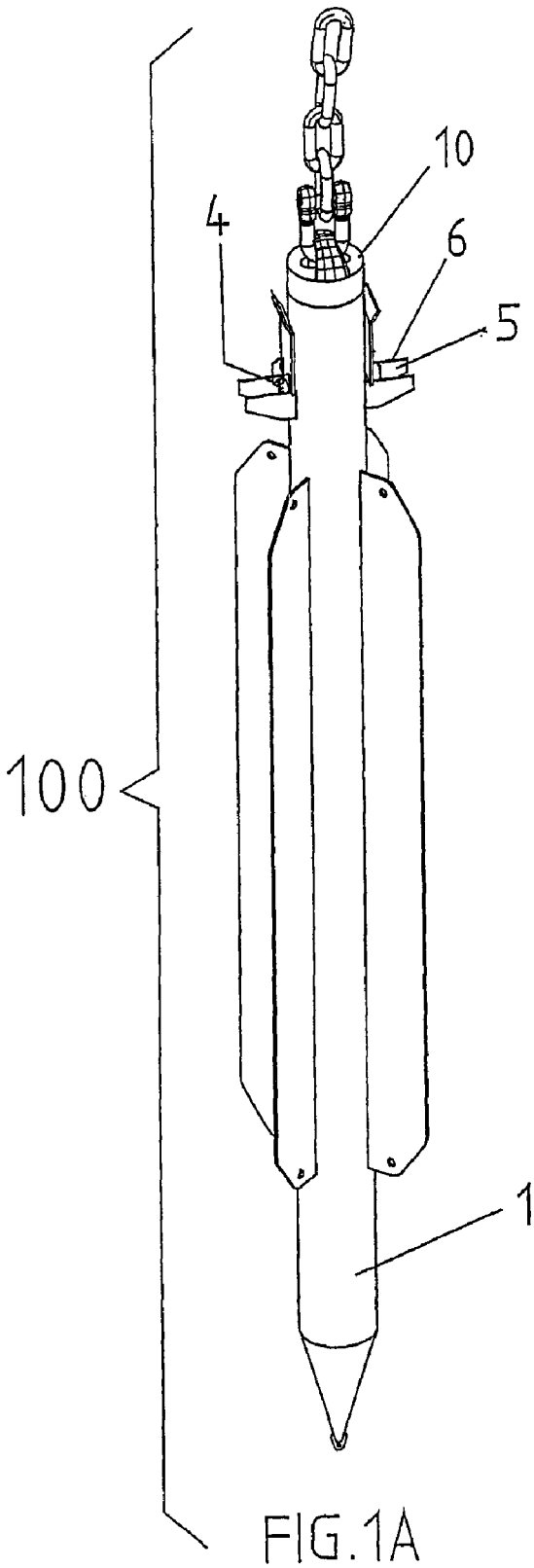
FIG. 1A shows the pile with the flaps closed.
Figure 1B:
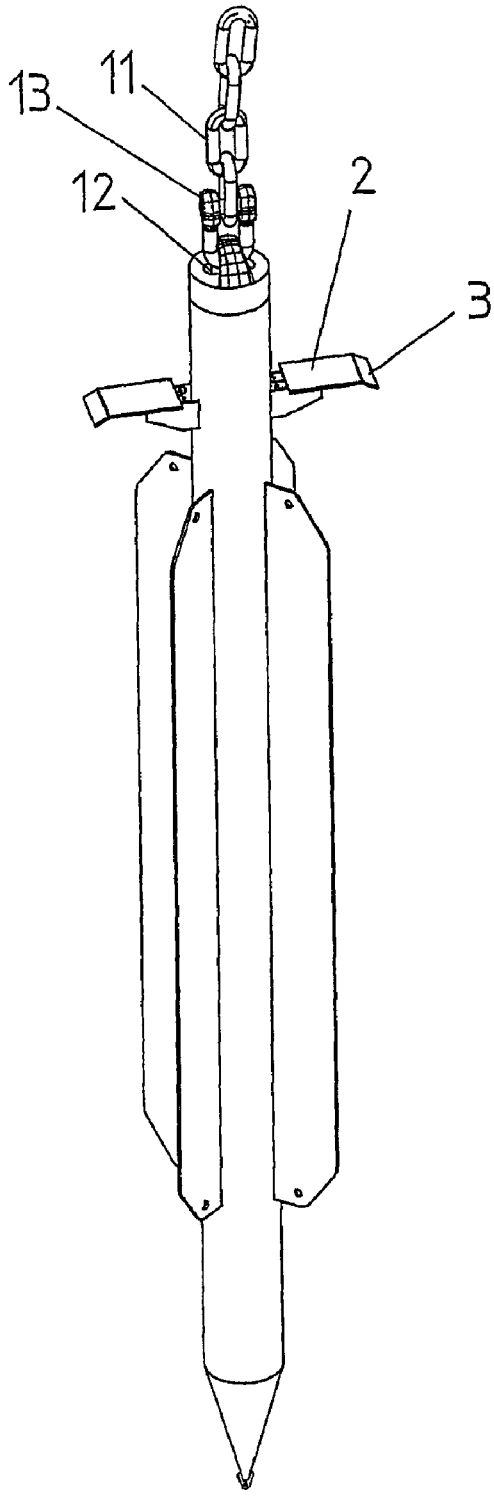
FIG. 1B shows the pile with the flaps open.

One embodiment of the invention is illustrated in FIGS. 1A and 1B.

The pile 100 according to this embodiment is intended for a permanent anchorage, with the pile remaining permanently in the seabed.

As illustrated in FIGS. 1A and 1B, the pile 100 consists of a body 1, with the lower end provided with a tipped point 30 and the upper end provided with plates 2 provided with flaps 3, said flaps being capable of inducing a rotation of the plates and articulated elements 4 when a vertical movement force or dragging force is exerted on the pile. With the continuation of a dragging force, the plates 2 continue to rotate as far as a final configuration in which they are substantially horizontal, when they reach the points of contact 6 of the stops 5.

In the configuration according to FIG. 1, the stops 5 are fixed, arranged in the body 1 of the pile. The initial arrangement of the plates 2 in their vertical configuration allows the pile to more easily penetrate the sea-bed. When a dragging force is applied, the plates move down to enhance the anchoring of the pile.

In the configuration of FIG. 2, the stops 5 are attached to the movable plates 2.

The flaps 3 are preferably themselves plates attached to the plates 2. They are preferably attached at an angle to the plates 2 such that when the plates 2 are vertical, the flaps extend at an angle from the vertical, e.g. 10-45°, more preferably 30°. This helps to ensure the uprooting force moves the plates so as to deploy them in the clamping position.

In each embodiment, the top of the upper end of the pile 100 is provided with an eye 11 for connection to a dragging force fitting such as a cable or chain 10.

The eye 11 has a configuration that will allow a dragging force to be exerted on it in any direction, and not only in the vertical direction as with the eyes according to the prior art. In addition, the base of the eye 11 has an aperture 12 such as to allow for the fitting of a link 13 with contact between the sling of the eye 11 and the loop or link of the cable or chain 13.

The method of installation of the pile 100 for the permanent anchoring arrangement illustrated in FIG. 1 comprises the launching of said pile from a tugboat, the pile being lowered by cables or other devices and then allowed to fall so as to embed itself by gravity, as described in WO 98/08733. In order to attain the enhanced clamping strength, after the embedding of the pile 100 a small vertical movement or dragging force is effected on it in such a way as to cause the flaps 3 of the plates 2 to be actuated, the flaps causing a rotation of the articulated elements 4; with the continuation of the vertical movement, the plates 2 continue to rotate as far as a final configuration when they reach the points of contact 6 of the stops 5.

Figure 2A:
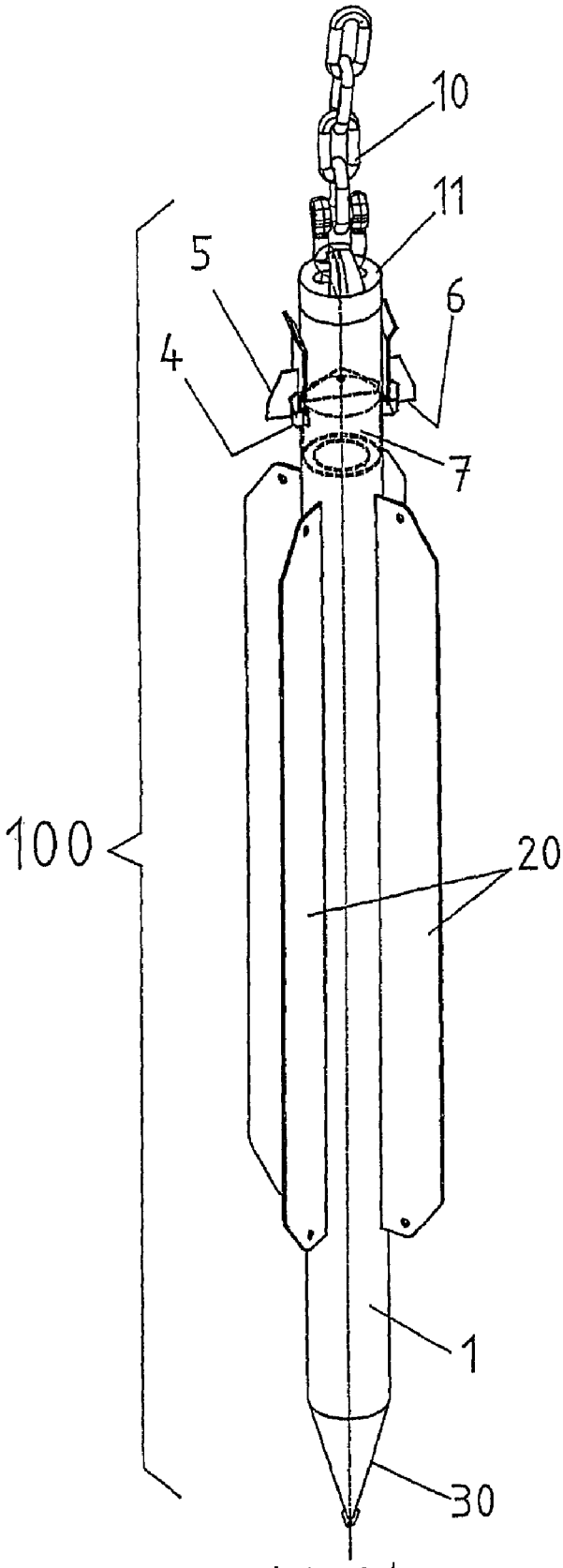
Figure 2B:
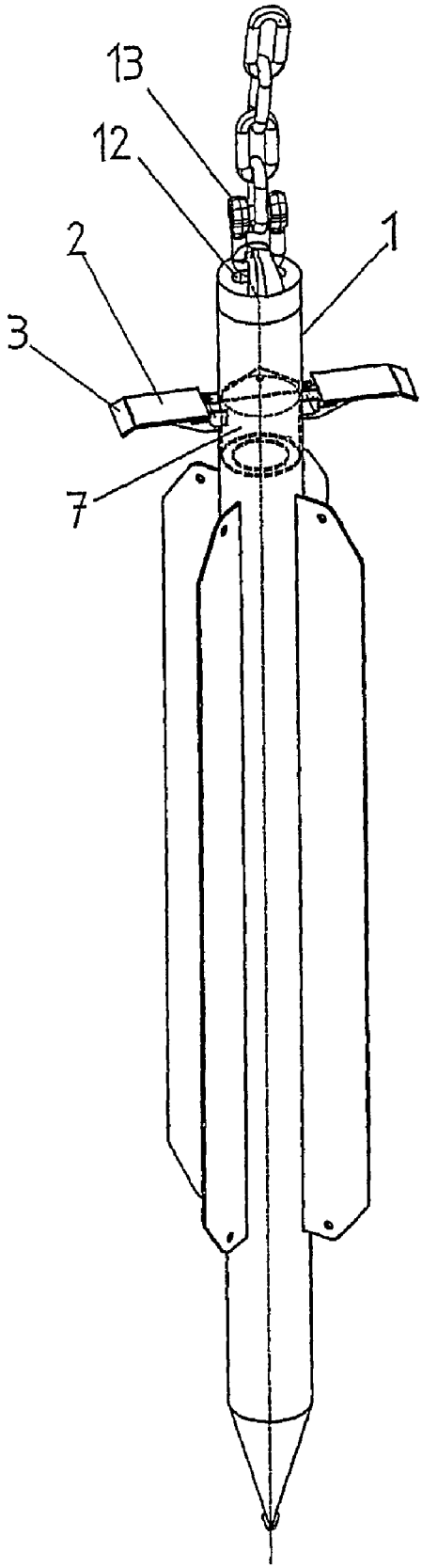
FIG. 2B shows the pile with the flaps open.

The second embodiment of the invention comprises a pile 100 which is embedded and then withdrawn from the seabed. This embodiment, intended for temporary anchorage, is illustrated in FIGS. 2A and 2B.

Accordingly, in order to allow the pile 100 to be withdrawn, if necessary, the points of contact 6 of the stops 5 are located in a movable cylinder 7 installed in the interior of the body 1 of the pile 100. The stops 5, which in this case are fixed in the plates 2 as illustrated in FIGS. 2A and 2B, reach the movable cylinder 7 after passing through the openings 8 in the wall of the body 1 of the pile 100.

Before the operation of withdrawing the pile 100 from the seabed with the aid of the cable or chain 10 connected to an eye 11 and actuated by the floating equipment of the installation, the movable cylinder 7 is moved upwards by means of a cable 9 connected to its top (see FIG. 3), which can be actuated by the floating equipment of the installation or by a remote-controlled operating vehicle (ROV).

This operation allows the openings 8 to be fully opened such that the stops 5 can be moved into the interior of the body 1 of the pile 100 until the plates 2 are parallel to the body 1. In this position, the area of reaction of the pulling of the plates 2 of the body 1 is the same as exists at the time of embedding.

Figure 3C:
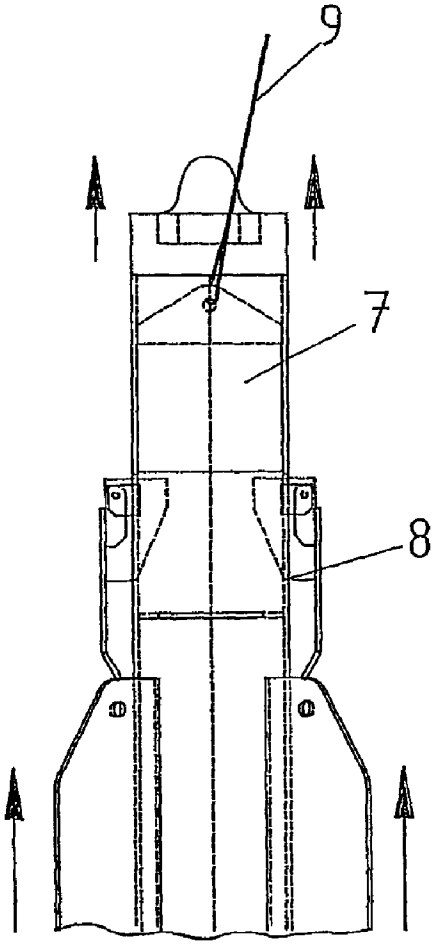
FIG. 3C shows the pile during the withdrawal process with the flaps closed and turned downwards.
Figure 3B:
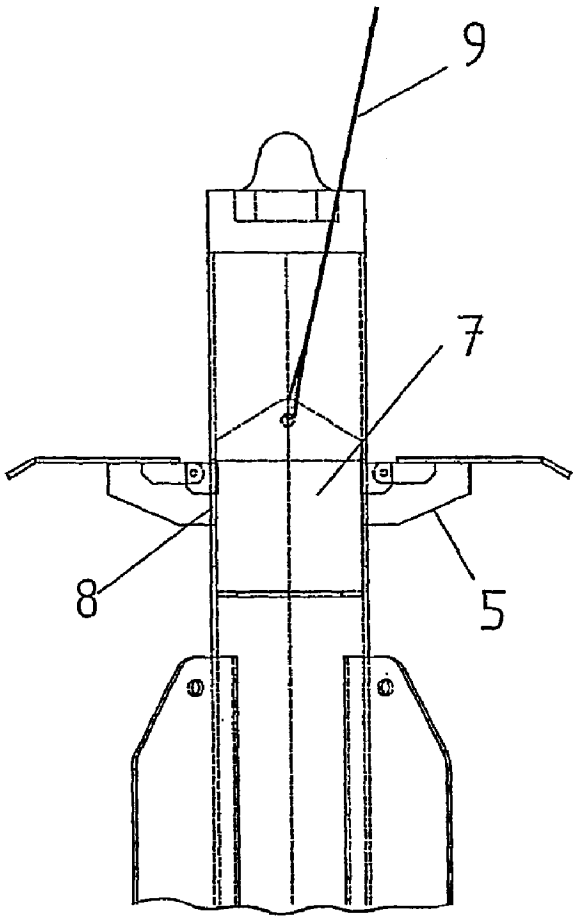
FIG. 3B shows the start of the process of withdrawal of the pile with the movement of the movable cylinder upwards.
Figure 3A:
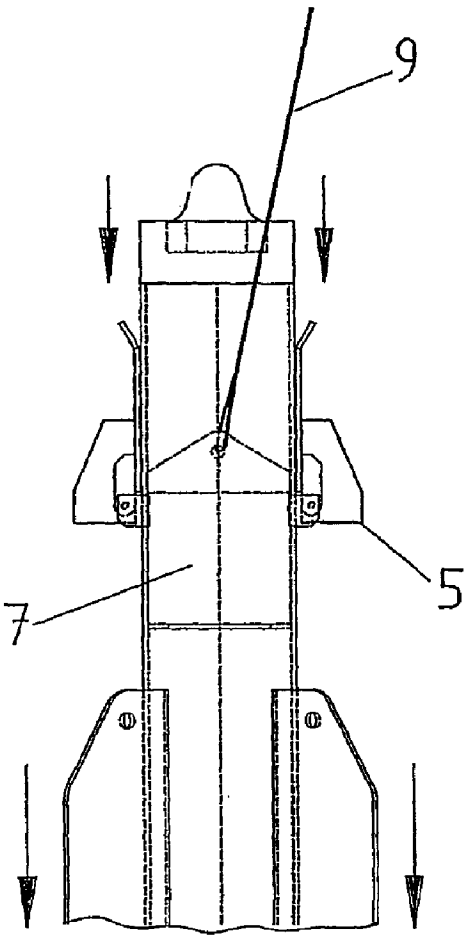
FIG. 3A shows the start of the embedding of the pile, with the flaps closed and turned upwards.

The sequence of this operation of withdrawal of the pile 100 from the seabed is shown in FIGS. 3A, 3B and 3C.

The method of installation of the pile 100 for temporary anchoring illustrated in FIGS. 2A and 2B comprises, after embedding by gravity, the movement of the movable cylinder 7 upwards by means of a cable 9 connected to its top, in such a way as to move the stops 5, said stops passing through apertures 8 into the interior of the body 1 until the plates 2 are parallel to the body 1 in such a way as to permit said pile to be withdrawn.

It will be clear to the person skilled in the art that although the Figures illustrate piles 100 in which two movable plates 2 are installed in a same section, an additional number of plates can be installed in a same section or in various transverse sections along the body 1 of the pile 100, preferably distributed in a symmetrical manner.

The use of the system proposed here in the anchoring of floating structures for drilling and production of oil, can represent a considerable reduction in the costs of installation of these structures, considering that elements are used which are of low cost and easy handling.

Torpedo type piles of the type described in the present application can be used in anchoring arrangements of the "taut leg" type, which require resistance to withdrawal, or in conventional anchoring, when the presence of oil wells or discharge pipes impedes the installation of dragging anchors.

The invention claimed is:

1. A torpedo pile with enhanced clamping strength for vertical load anchoring, comprising a body with vertical fins along the body, having, in a lower end thereof, a pointed tip for embedding the pile permanently into a seabed and, in an upper end thereof, an eye for connection to a dragging force fitting and at least two articulated movable plates provided with flaps being capable of inducing a rotation of respective plates and articulated elements, when the dragging force is exerted vertically on the pile upper end, until the articulated movable plates are substantially horizontal and reach stops fixed to the pile.

2. The torpedo pile according to claim 1, wherein the pile additionally comprises a movable cylinder with the stops being fixed to the plates, the movable cylinder being located in the interior of the body and configured such that said movable cylinder can be moved upwards by a cable connected to its top to induce the stops to move into the interior of the body through openings so that the plates move to be parallel to the body of said pile and the pile can be withdrawn from the seabed.

3. The torpedo pile according to claim 1, wherein the eye has a configuration such as will allow for a dragging force in any direction.

4. The torpedo pile according to claim 1, wherein the plates are distributed symmetrically in the body.

5. The torpedo pile according to claim 1, wherein taut leg anchoring arrangements are used.

6. The torpedo pile according to claim 1, wherein conventional anchoring arrangements are used.

7. A method of installation of the pile according to claim 1, wherein the method comprises, after embedding of said pile in the seabed, exerting a slight vertical movement or dragging force in such a way as to cause the flaps to actuate, inducing a rotation of the plates and the articulated elements such that, with the continuation of the vertical movement, the plates continue to rotate as far as a final configuration, substantially horizontal, when the stops are reached.

8. The torpedo pile according to claim 1, wherein the vertical fins extend across a center of the torpedo pile between the pointed tip and the upper end.

9. The torpedo pile according to claim 1, wherein the two articulated movable plates are pivotally attached to the body adjacent the upper end of the body.

10. The torpedo pile according to claim 1, wherein the body comprises a cylindrical shape and the vertical fins extend along the cylindrical shape between the pointed tip and the two articulated movable plates.

* * * * *